US008141271B2

(12) United States Patent
McClaskie et al.

(10) Patent No.: US 8,141,271 B2
(45) Date of Patent: Mar. 27, 2012

(54) SHOE WITH IMPROVED CONSTRUCTION

(75) Inventors: Thomas E. McClaskie, Bethlehem, PA (US); Anup Kishore Mukherjee, Hollis, NH (US)

(73) Assignee: Columbia Insurance Company, Omaha, NE (US)

( * ) Notice: Subject to any disclaimer, the term of this patent is extended or adjusted under 35 U.S.C. 154(b) by 631 days.

(21) Appl. No.: 12/323,678

(22) Filed: Nov. 26, 2008

(65) Prior Publication Data

US 2010/0126039 A1 May 27, 2010

(51) Int. Cl.
*A43B 3/12* (2006.01)
*A43B 9/02* (2006.01)

(52) U.S. Cl. ..... 36/12; 36/21; 36/22 R; 12/142 T; 12/142 C

(58) Field of Classification Search ..... 36/12, 16, 36/18, 19 R, 21, 22 R; 12/142 T, 142 C
See application file for complete search history.

(56) References Cited

U.S. PATENT DOCUMENTS

| | | | | |
|---|---|---|---|---|
| 1,600,620 | A * | 9/1926 | Buek, Jr. | 36/12 |
| 1,600,621 | A * | 9/1926 | Buek, Jr. | 36/3 A |
| 2,073,543 | A * | 3/1937 | Wernmark | 36/12 |
| 2,119,392 | A * | 5/1938 | Levin | 36/12 |
| 4,250,638 | A | 2/1981 | Linnemann | |
| 4,308,671 | A * | 1/1982 | Bretschneider | 36/11 |
| 4,685,223 | A * | 8/1987 | Long | 36/16 |
| 6,574,886 | B1 * | 6/2003 | Issler | 36/12 |
| 6,691,360 | B2 | 2/2004 | Mukherjee et al. | |
| 6,966,128 | B2 * | 11/2005 | McClaskie | 36/12 |
| 6,976,320 | B2 * | 12/2005 | McClaskie | 36/11.5 |
| 7,020,987 | B2 * | 4/2006 | Issler | 36/19 R |
| 7,168,187 | B2 | 1/2007 | Robbins | |
| 7,322,128 | B2 * | 1/2008 | Issler | 36/21 |
| 7,454,848 | B2 * | 11/2008 | Issler | 36/12 |
| 7,836,609 | B2 * | 11/2010 | Covatch | 36/17 R |
| 2007/0062064 | A1 | 3/2007 | McClaskie | |
| 2008/0244934 | A1 * | 10/2008 | Covatch | 36/17 R |

* cited by examiner

*Primary Examiner* — Marie Patterson
(74) *Attorney, Agent, or Firm* — St. Onge Steward Johnston & Reens LLC

(57) ABSTRACT

A shoe construction wherein the upper is secured to the outsole by a stitch, and the upper folds inwardly in a first portion of the shoe and outwardly in a second portion of the shoe. The stitch allows an upper row of the stitching to be visible on the outside of the upper in one portion of the shoe but not visible on the outside of the upper in a different portion of the shoe.

14 Claims, 7 Drawing Sheets

SHOE WITH IMPROVED CONSTRUCTION

FIELD OF THE INVENTION

The invention relates to a shoe having an improved shoe construction, resulting in reduced manufacturing costs, durability, and an attractive appearance.

BACKGROUND OF THE INVENTION

A variety of different sole constructions are used by the footwear industry. For the most part, each sole construction has characteristics that make it particularly well-suited for specific applications. For example, some sole constructions are selected for their durability, others for their flexibility and comfort, while still others are selected for their aesthetic appeal.

One well-known type of shoe construction is referred to as a welt construction, which is typically a strip of material such as leather or hard rubber used to secure the sole and the upper together. Welt constructions generally provide durability and aesthetic appeal. FIG. 1 is a cross sectional view of a conventional Goodyear welt construction. This construction usually includes a welt 10 that connects an upper 12 and a sole 14. The welt 10 often includes a base portion 16 with an upwardly extending rib 18 located toward the center of the base portion and a downwardly extending rib 19 located at the inner edge of the base portion 16. The sole 14 may include an insole 20, a midsole 22, and an outsole 24. The insole 20 typically includes a downwardly extending rib 26 that is used to connect the insole 20, upper 12 and welt 10.

Welt construction typically involves a number of manufacturing operations or steps. Normally, the upper is wrapped around a last and secured to the insole by stapling, stitching, or other fastening mechanism. This step typically provides the upper with a desired shape and is commonly referred to as lasting. Once lasted, the welt is usually secured to the upper and insole by stitches or staples that extend through downwardly extending rib 19, the bottom periphery of the upper 12, and the insole rib 26. The midsole may be secured to the bottom of the upper/insole assembly. Typically, the midsole is attached to the upper/insole assembly by stitching that extends through the base portion 16 of the welt 10 and the midsole 22. Although this construction is believed to be durable and aesthetically appealing, it is generally a heavy construction and typically does not provide flexibility relative to other shoe constructions. Moreover, due to the number of manufacturing operations specified above, the cost of providing a welt construction shoe may be higher than other shoe constructions.

Cementing components of a shoe, such as the upper to the midsole or outsole, also often involves a number of manufacturing operations. Typically, there is a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another. Once the components are pressed together, cementing often requires a waiting period for the cement to cure, or dry. Generally, not only does cementing involve some or all of the above mentioned manufacturing operations, it also involves time, particularly the curing time.

It is believed that the number of steps and time involved, especially if user intervention is required, negatively affects cost and efficiency. The cementing process may be further complicated if the surfaces to be glued are uneven or difficult to reach.

It is also well-known to construct shoes using an Opanka construction. In an Opanka construction, the outsole of the shoe is sewed to the upper of the shoe along an outer periphery of the outsole. The Opanka construction is described in currently pending U.S. Application Publication No. 2007/0062064. FIG. 2 shows a cross-sectional view of a shoe having an Opanka construction, where an upper 12 is secured to an outsole 14 using a thread 36 that passes through a plurality of holes in the upper 12 and the outsole 14. A channel 38 is provided on the outsole 14 to help prevent the stitched thread 36 from being worn quickly due to contact with the ground.

In the example shown in FIG. 2, it is apparent that the Opanka construction or stitching produces two rows of stitching: an upper row is formed on the outer periphery of the upper and a lower row is formed in the channel 38. In other Opanka-constructed shoes, the lower row is formed on a side of the outsole 14 so that it is visible along with the upper row. In still other Opanka-constructed shoes, one of the lower or upper rows of stitching will be formed on the inside of the upper, and thus will not be visible.

When constructing certain types of shoes, it is often desirable to vary the stitching pattern or the way in which the upper and outsole are joined between the front of the shoe and the back of the shoe. For example, in shoes that are intended for hiking or heavier outdoor use, it is often desirable to protect the stitching in the toe area from abrasion and wear. At the same time, it may be desirable to utilize an Opanka stitch wherein both an upper row and a lower row of the stitching are readily accessible on the outside of the shoe. Alternatively, it may be desirable for the upper to be folded inwards as it is joined to the outsole in the toe region and outwards as it joins the outsole in the heel region. Such variation between the toe of the shoe and the heel of the shoe may be desirable for various reasons, including, simplicity of design, simplicity of manufacturing, aesthetic appeal, and the like.

Previously, accomplishing such variation in a shoe caused a substantial increase in the cost of manufacturing such a shoe. This increase in cost was often due to the need to utilize two or more stitching techniques to accomplish the variation in shoe construction from the front of the shoe to the back of the shoe. For example, U.S. Pat. No. 4,250,638 to Linnemann appears to disclose a shoe construction in which the upper is folded inwards in the heel area and folded outwards in throughout the rest of the shoe. However, the upper is secured by a different stitch in each of the two different areas of the shoe: a backstitch is used in the heel and a pricking stitch is used around the rest of the shoe.

What is needed, therefore, is a shoe that may be constructed in a more efficient manner, by reducing manufacturing costs and involving fewer manufacturing operations, but that permits variation in the shoe construction in different portions of the shoe where the upper meets the outsole.

SUMMARY OF THE INVENTION

It is an object of the present invention to provide a shoe that has a varying construction in different portions of the shoe.

It is a further object of the present invention to provide a shoe having a construction that varies in different portions of the shoe that is constructed in an efficient, cost-effective manner.

It is still another object of the present invention to provide a shoe construction wherein the stitching used to secure the upper to the outsole is protected from wear and abrasion in areas that are particularly susceptible to wear and abrasion, such as the toe area.

These and other objects are accomplished according to the present invention by provision of a shoe comprising: an outsole having a lip extending around a periphery of the outsole; an upper having an inside and an outside for securing to the outsole adjacent to the lip; wherein the outside is facing and is secured to the outsole by a stitch in a first portion of the periphery; and wherein the inside is facing and is secured to the outsole by the stitch in a second portion of the periphery.

In some embodiments, the outsole includes a first hole, a second hole, a third hole, and a fourth hole; the upper includes a right hole and a right center hole aligned with the first and second holes and a left center hole and a left hole aligned with the third and fourth holes; and a first thread extending from the first hole, through the right hole, through the right center hole, through the second hole, and through the third hole; and a second thread extending from the right hole, through the first hole, through the second hole, through the left center hole, and through the third hole.

In some embodiments, the shoe comprises a socklining beneath the outside and the inside but above the outsole. In some embodiments, the outsole of the shoe includes a side surface, a top surface, and a lip surface; the outside is facing and is secured to the lip surface; and the inside is facing and is secured to the top surface. In some embodiments, the first hole and the second hole extend from the top surface to the side surface; and the third hole and the fourth hole extend from the lip surface to the side surface.

In some embodiments, the inside is facing and is secured to the top surface in a rear part of the shoe and the outside is facing and is secured to the lip surface in a front part of the shoe. In some embodiments, the stitch comprises an upper row of stitching on the upper and a lower row of stitching on the side surface of the outsole; the lower row of stitching is visible on the side surface of the outsole in the first and second portions of the periphery; and the upper row of stitching is visible on the outside of the upper in the second portion of the periphery and the upper row of stitching is not visible in the first portion of the periphery.

In a second embodiment of the present invention, a shoe is provided, comprising: an outsole that includes a lip extending around a periphery of the outsole and an upper including a right hole, a right center hole, a left center hole, and a left hole. The outsole includes a side surface, a top surface, and a lip surface and a first hole and a second hole extending from the top surface to the side surface and a third hole and a fourth hole extending from the lip surface to the side surface. A first thread extends from the first hole, through the right hole, through the right center hole, through the second hole, and through the third hole. A second thread extends from the right hole, through the first hole, through the second hole, through the left center hole, and through the third hole.

In some embodiments, the upper has an inside and an outside; the inside is facing and secured to the top surface by the first thread; and the outside is facing and secured to the lip surface by the second thread. In some embodiments, the shoe further includes a channel in the side surface extending around the periphery of the outsole.

According to a third embodiment of the present invention, a method for constructing a shoe is provided, comprising the steps of: providing an outsole comprising a lip that extends around a periphery of the outsole; creating a first hole and a second hole in a first portion of the periphery; creating a third hole and a fourth hole in a second portion of the periphery; providing an upper with a left hole, a left center hole, a right center hole, and a right hole, the upper having an inside and an outside; and securing the upper to the outsole by a stitch. The securing step comprises extending a first thread from the first hole, through the right hole, through the right center hole, through the second hole, and through the third hole; and extending a second thread from the right hole, through the first hole, through the second hole, through the left center hole, and through the third hole.

In some embodiments, the securing step further comprises: securing the inside against the outsole; and securing the outside against the outsole. In some embodiments, the step of providing an outsole further comprises forming a side surface, a top surface, and a lip surface around the periphery of the outsole. In some embodiments, the step of creating a first hole and a second hole further comprises extending the first hole and the second hole from the top surface to the side surface; and the step of creating a third hole and a fourth hole further comprises extending the third hole and the fourth hole from the lip surface to the side surface.

In some embodiments, the upper has an inside and an outside, and the securing step further comprises: securing the inside against the top surface of the outsole; and securing the outside against the lip surface of the outsole.

Accordingly, embodiments of the present invention provide a simple, cost-effective construction of a shoe that allows variation in the manner in which the upper is secured to the outsole, so that the stitching can be protected from wear and abrasion in the areas of the shoe most susceptible to wear and abrasion.

The invention and its particular features and advantages will become more apparent from the following detailed description considered with reference to the accompanying drawings.

DETAILED DESCRIPTION OF THE INVENTION

Figure 1:
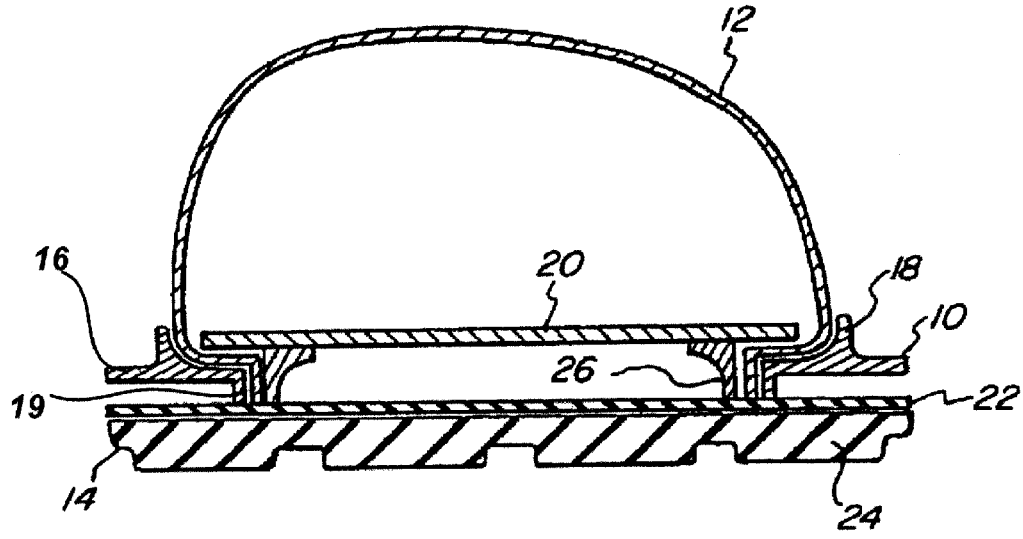
FIG. 1 (PRIOR ART)
FIG. 1 is a cross-sectional view of a shoe with a welt construction representing the prior art.
Figure 2:
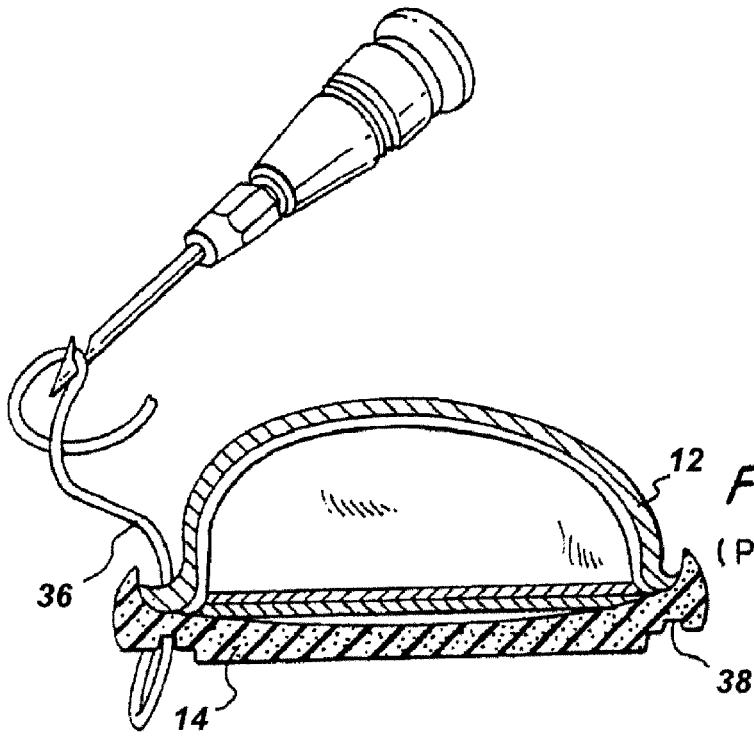
FIG. 2 (PRIOR ART)
FIG. 2 is a cross-sectional view of a shoe with an Opanka construction representing the prior art.
Figure 3:
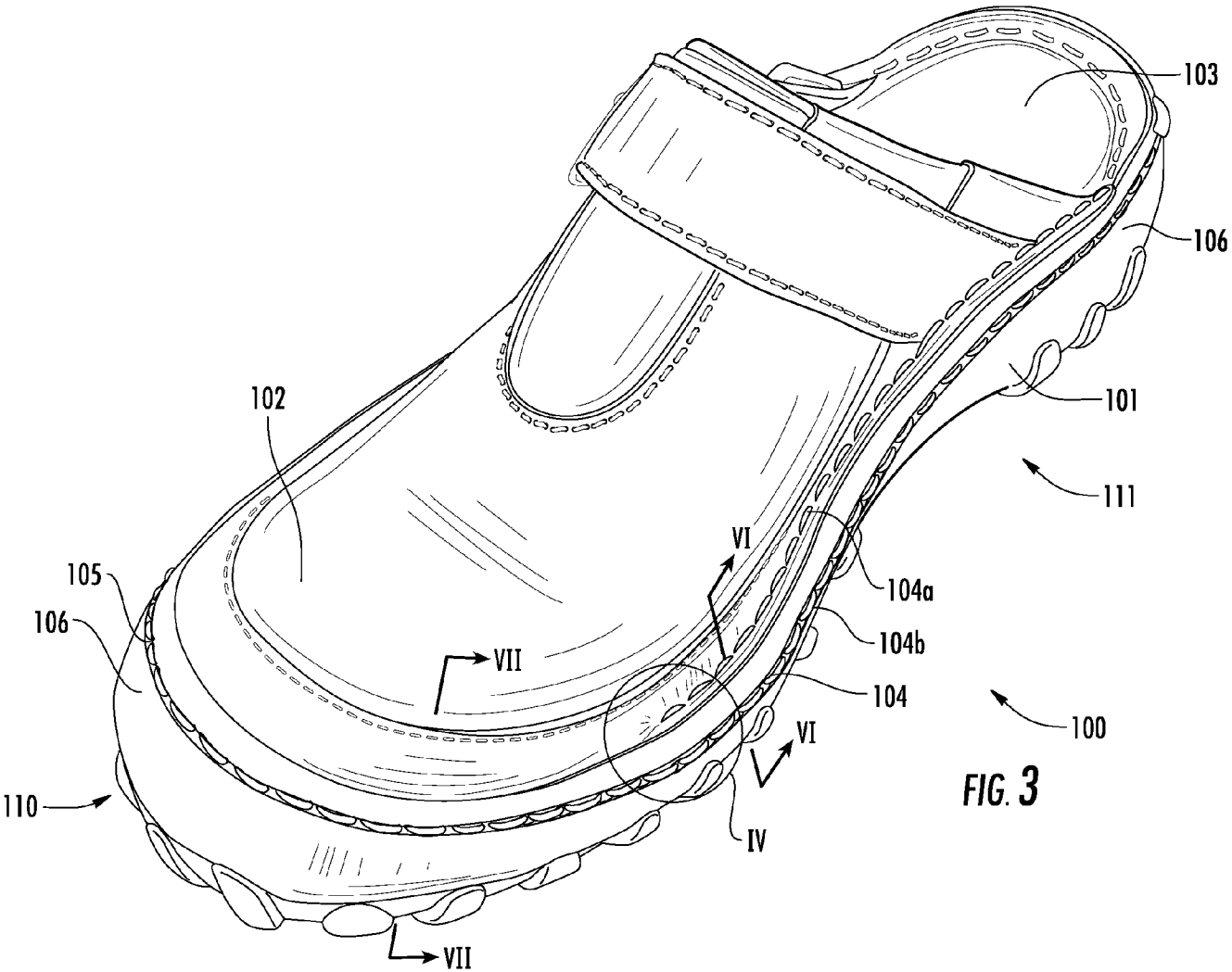
FIG. 3 is a perspective view of a shoe having an improved construction according to the present invention.

Embodiments of the present invention will now be described with reference to FIGS. 3-8. FIG. 3 shows a shoe 100 constructed in accordance with the present invention. The shoe 100 includes an outsole 101, an upper 102, a socklining 103, and a stitch 104 that secures the outsole 101 to the upper 102. The stitch 104 has an upper row of stitching 104*a* and a lower row of stitching 104*b*. Both the upper row 104*a* and the lower row 104*b* run around the bottom periphery of the upper 102 and the top periphery of the outsole 101. The shoe 100 could generally be characterized has having an Opanka construction, as the outsole 101 and the upper 102 are sewed directly to one another.

The outsole 101 is provided with a channel 105 on its side surface 106. The lower row 104*b* of the stitch 104 is disposed within the channel 105 to protect the thread from abrasion and wear. In the embodiment shown in FIG. 3, the stitch 104 is formed using two threads, as described in detail below. The threads utilize holes formed on the top periphery of the outsole 101 that are aligned with holes formed on the bottom periphery of the upper 102.

As shown in FIG. 3, the upper row 104*a* of the stitch 104 is not visible on the outside of the upper 102 around the entire periphery of the shoe. The upper row 104*a* is visible in the rear portion of the shoe 100, but is not visible in the front or toe portion of the shoe. In the area designated in general by Roman numeral IV (this area is shown in detail in FIG. 4) the transition between the visibility of upper row 104*a* to its invisibility on the outside of the upper 102 is shown. In the portion of the shoe where the upper row 104*a* is visible, the upper 102 is folded outwardly as it is secured to the outsole 101. In the portion of the shoe where the upper row 104*b* is not visible, the upper 102 is folded inwardly as it is secured to the outsole 101. Thus, in the toe portion of the shoe, only the lower row 104*b* of the stitch 104 is visible and this lower row 104*b* is protected by the channel 105. By this shoe construction, the stitch 104 is very well protected from abrasion and wear, which is likely to occur in the toe portion of the shoe.

Figure 4:
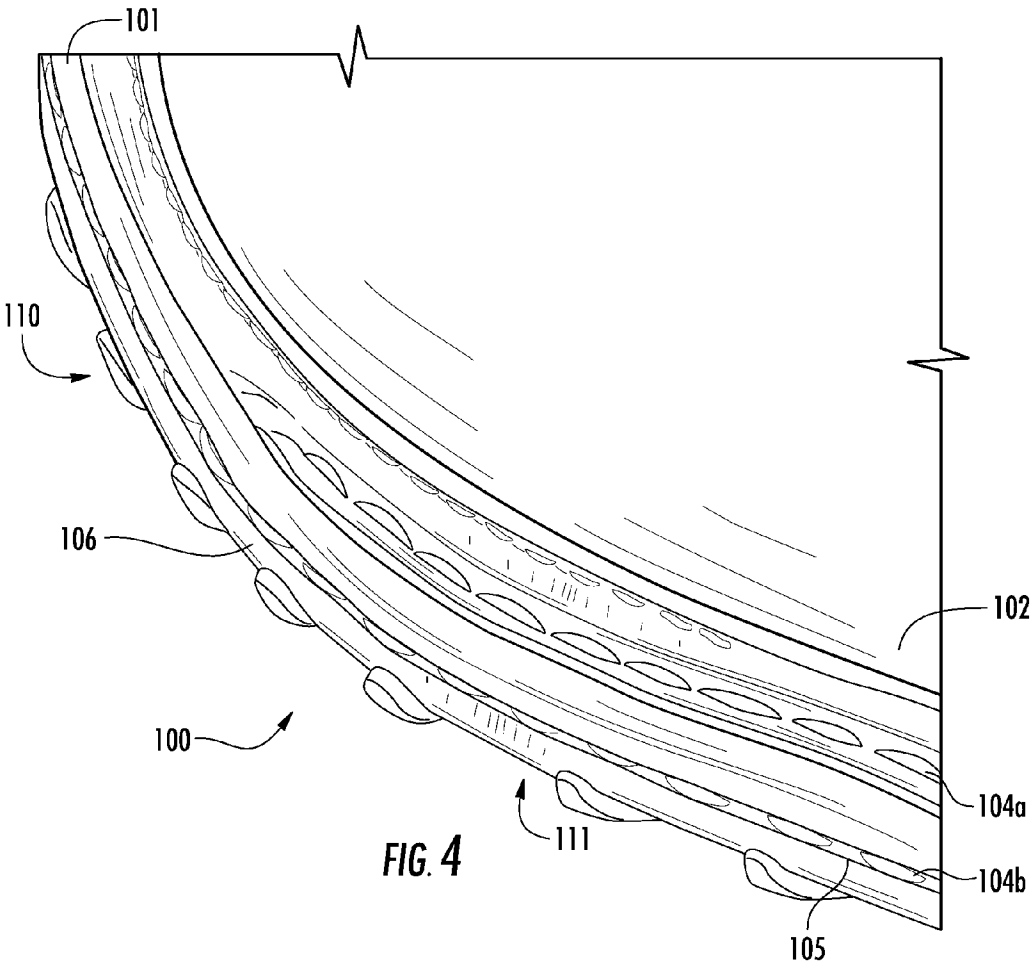
FIG. 4 is a close-up top view of a portion of the shoe of FIG. 3 designated by IV.

FIG. 4 shows a close-up, detailed view of the region designated generally by Roman numeral IV in FIG. 3. In this region, the upper row of stitching 104*a* is shown to cease being visible on the upper 102. Of course, a similar transition exists on the opposite side of the shoe 100, but this transition is not shown in FIG. 3 or 4. Thus, the upper row of stitching 104*a* is not visible in the toe portion of the shoe 100, but is visible in the rear portion of the shoe 100. One of ordinary skill in the art will readily recognize that the portion of the shoe in which the upper row of stitching is not visible is variable and does in fact vary in other embodiments of a shoe according to the present invention. For example, the upper row of stitching may be not visible in the rear portion of the shoe, or only on the side portions of the shoe. The present invention contemplates a shoe construction in which there are more than two sections having differing constructions. In some embodiments, the upper 102 folds outwardly as it is secured to the outsole 101 on the sides of the shoe, while the upper 102 folds inwardly as it is secured to the outsole 101 in the toe and heel portions of the shoe. The simplicity of the stitch 104 permits the shoe construction to vary many times on a single shoe without significantly adding to the cost of manufacturing the shoe.

Figure 5:
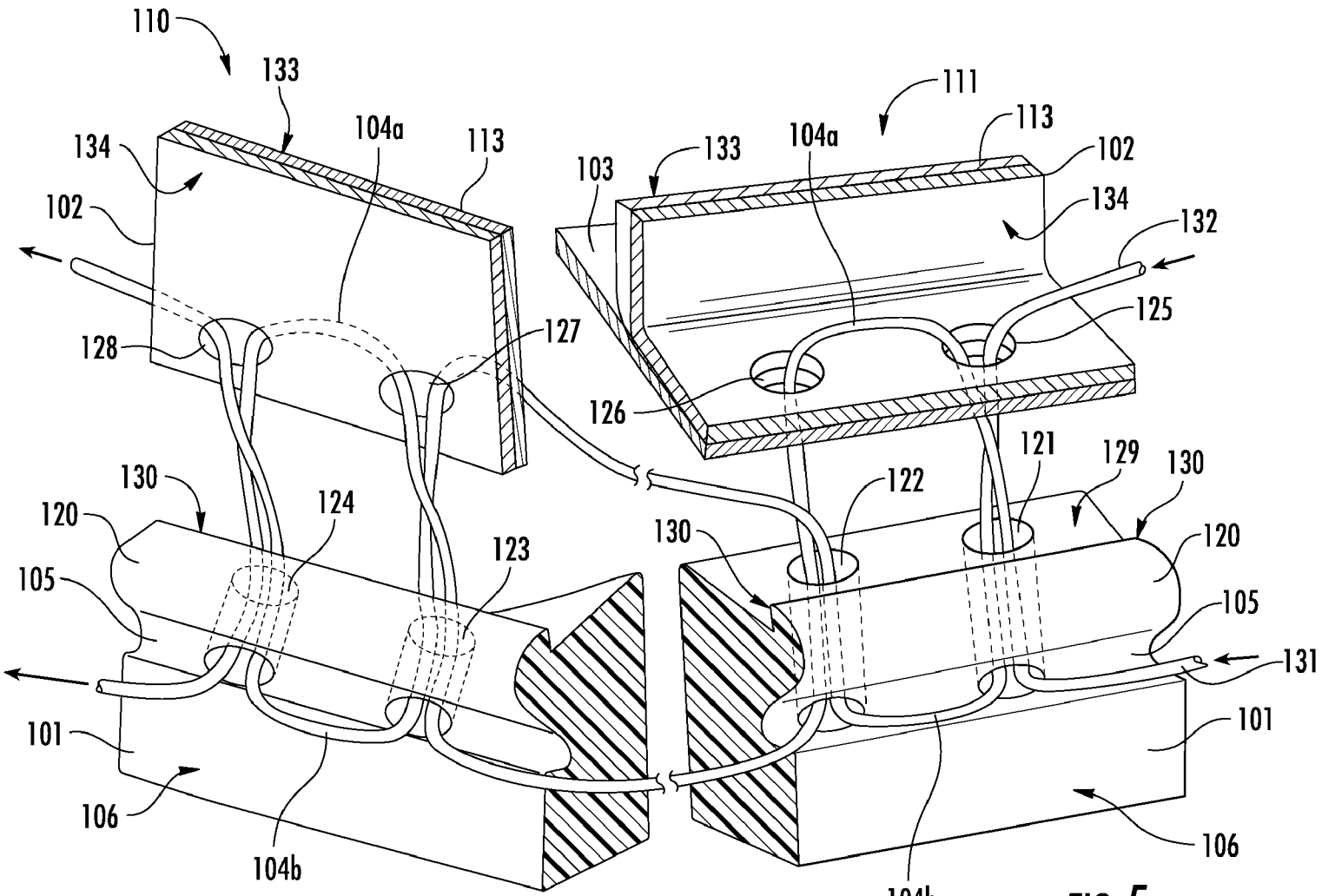
FIG. 5 is a schematic view of the shoe construction according to the present invention.

FIG. 5 is a schematic view of the transition between a first portion of the shoe (indicated generally by reference number 110) where the upper row of stitching 104*a* is not visible and a second portion of the shoe (indicated generally by reference number 111) where the upper row of stitching 104*a* is visible. FIG. 5 shows how the same upper 102 and the same outsole 101 are joined by the same stitch 104 in two different regions of the shoe 100. Even though the upper 102 and the outsole 103 are each shown in two pieces in FIG. 5, it is to be understood that only a single upper 102 and a single outsole 101 is used.

FIG. 5 shows a lip 120 that runs around the periphery of the outsole 101. The lip 120 shown has a generally rounded profile, but different shapes and profiles are employed in other embodiments of the present invention. The lip 120 forms a lip surface 130 that faces generally into the page of FIG. 5 in the first portion 110 and the second portion 111 of the outsole. In the second portion 111 of the outsole 101, a top surface 129 is also present. In the first portion 110, the top surface 129 is not present but the lip surface 130 has a larger surface area.

Some of the holes that line the peripheries of the outsole 101 are shown. First hole 121 and second hole 122 extend from the top surface 129 through to the side surface 106 of the outsole 101. Third hole 123 and fourth hole 124 extend from the lip surface 130 through to the side surface 106 of the outsole 101. All of these holes open into the channel 105 on the side surface 106.

The upper 102 has holes that correspond to and align with the first, second, third, and fourth holes 121-124 in the outsole 101. Upper 102 has right hole 125, right center hole 126, left center hole 127, and left hole 128. Through these holes a first thread 131 and a second thread 132 are stitched to secure the upper 102 to the outsole 101. The first thread 131 is extended through first hole 121, through right hole 125, through right center hole 126, through second hole 122, through third hole 123, through left center hole 127, through left hole 128, and then through fourth hole 124. The second thread 132 is extended through right hole 125, through first hole 121, through second hole 122, through left center hole 127, through third hole 123, through fourth hole 124, and then through left hole 128. Of course, one of skill in the art will recognize that this pattern of stitching is used around the entire periphery of the shoe. The loops of stitching that form the upper and lower rows of stitching 104*a* and 104*b* that are visible are loops of the first thread 131 alternating with loops of the second thread 132. It should also be understood that, in some embodiments, the first thread 131 and the second thread 132 are merely different portions of a single thread. In other embodiments, more than two threads are used to comprise the stitch 104 around the periphery of the shoe 100.

The exception to this pattern, as shown in FIG. 5, is when second thread 132 is extended from second hole 122 directly to the left center hole 127, instead of the right center hole 126. The second thread 132 essentially "skips" right center hole 126. This skipping of a hole on the upper is what allows the upper row 104*a* of stitching to transition from the outside 134 of the upper 102 to the inside 133 of the upper 102. As shown in FIG. 5, the inside 133 of the upper 102 is facing and secured to the top surface 129 of the outsole 101 in the second portion 111. The outside 134 of the upper 102 is facing and secured to the lip surface 130 of the outsole 101 in the first portion 110.

The stitching pattern shown in FIG. 5 that is in the region of the transition between the first portion 110 and the second portion 111, is present in at least two locations on a shoe 100, generally on opposite sides. As noted above, however, many transitions are possible and contemplated on a single shoe. FIG. 5 also shows the socklining 103 being secured along with the upper 102 to the outsole 101.

One of ordinary skill in art will appreciate that the exact features of the outsole 101 depicted in the FIGs. are not a necessary part of the present invention and that alternative shapes in the region of the lip 120 are employed in other embodiments. For example, the top surface 129 may be present around the entire periphery of the outsole 101, including both the first portion 110 and the second portion 111. The top surface 129 may also be disposed at an angle different than that shown in FIG. 5. Alternatively, the outsole is formed without the top surface 129 and only with a lip surface 130.

Figure 6:
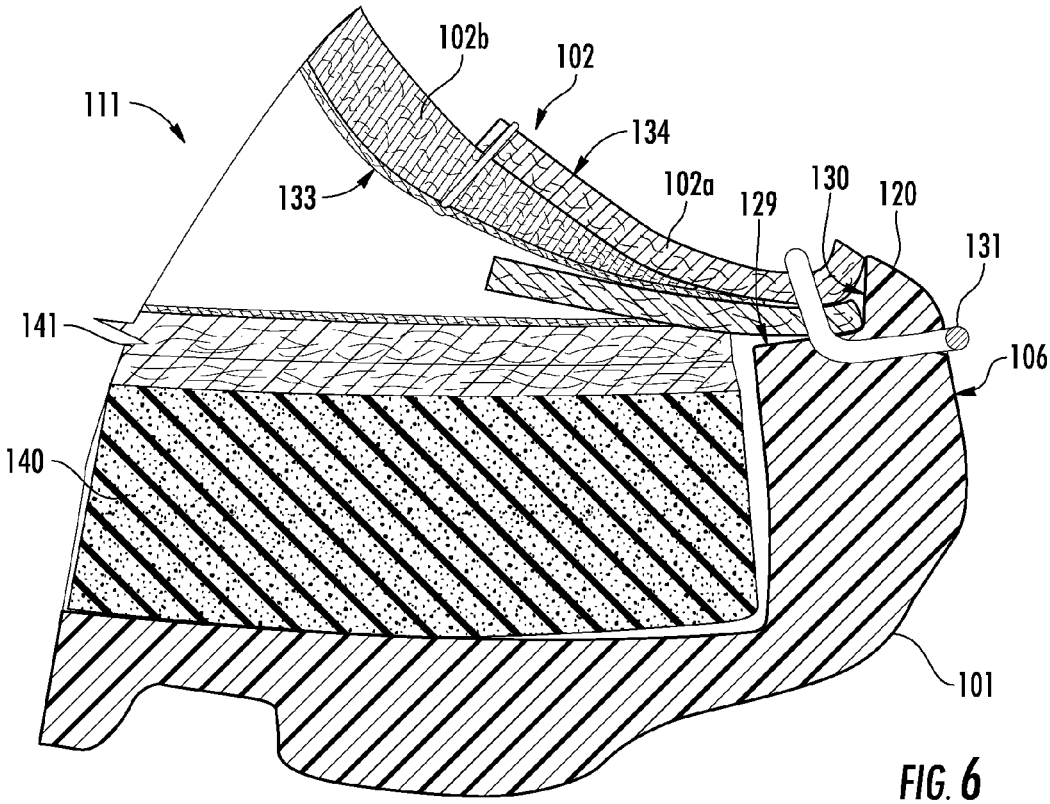
FIG. 6 is a cross-sectional view of the shoe of FIG. 3 taken along cut-plane VI.
Figure 7:
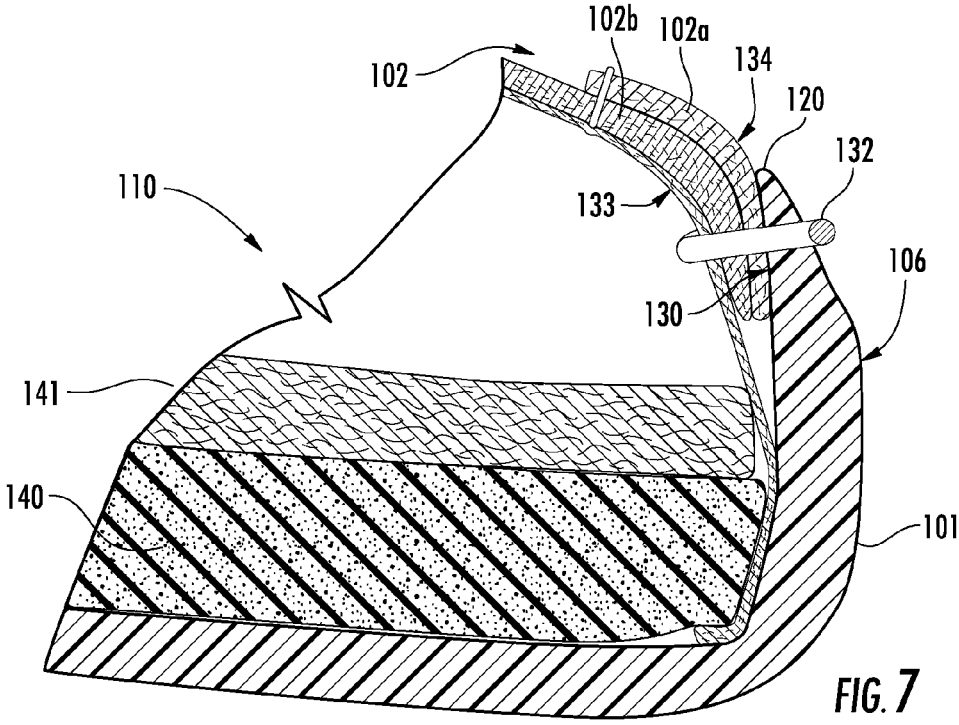
FIG. 7 is a cross-sectional view of the shoe of FIG. 3 taken along cut-plane VII.

FIGS. 6 and 7 show cross-sectional views of the shoe 100 shown in FIG. 3 in second portion 111 and first portion 110, respectively. FIG. 6 shows the upper 102 (which comprises an outer portion 102*a* and an inner portion 102*b*) secured to the outsole 101 by the first thread 131 in the second portion 111 of the shoe. The first thread 131 extends through a hole in the upper 102 and through a hole in the top surface 129 extending to the side surface 106.

FIG. 7 shows, in the first portion 110 of the shoe, the upper 102 secured to the outsole 101 by second thread 132. The second thread 132 extends through a hole from the lip surface 130 to the side surface 106 of the outsole 101. The difference in the orientation of the upper 102 is clearly shown in FIGS. 6 and 7. In FIG. 6, the inside 133 of the upper 102 is facing and secured to the top surface 129. However, in FIG. 7, the outside 134 of the upper 102 is facing and secured to the lip surface 130. FIGS. 6 and 7 also show other parts of the shoe 100, including cushioning 140 underneath an insole 141.

Figure 8:
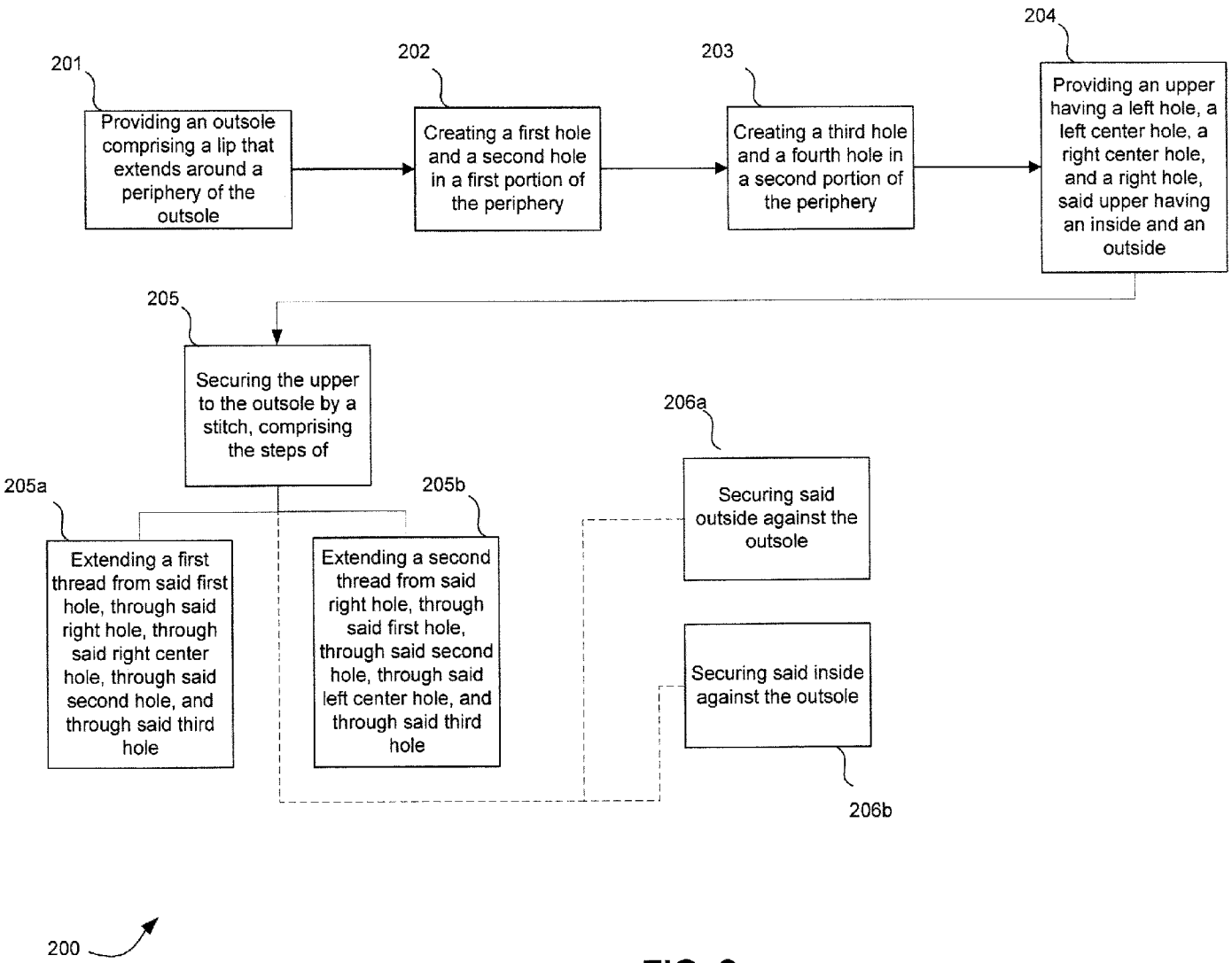
FIG. 8 depicts a method for constructing a shoe according to the present invention.
Figure 9:
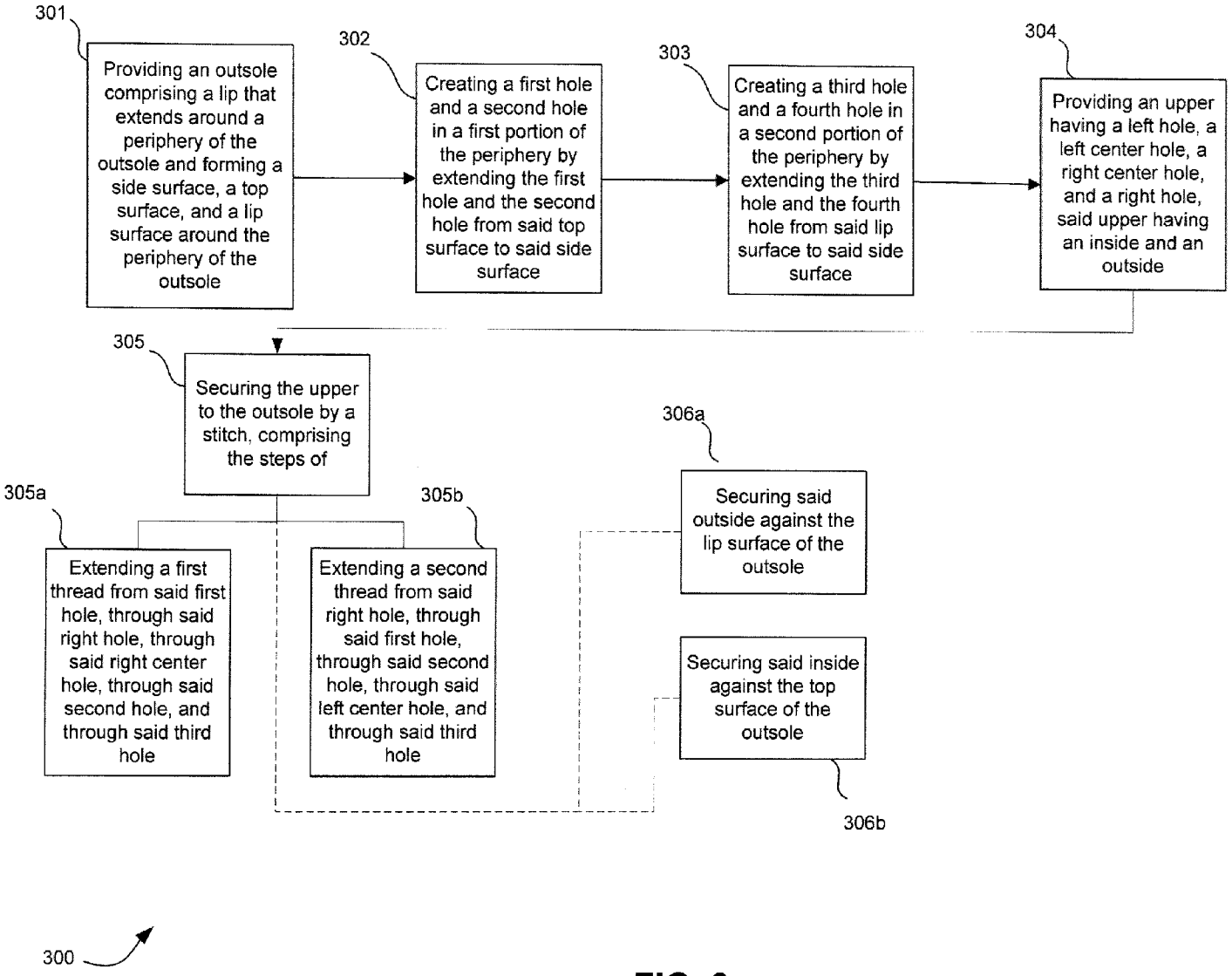
FIG. 9 depicts a method for constructing a shoe according to the present invention.

FIGS. 8 and 9 depict methods for constructing a shoe in accordance with the present invention. In FIG. 8, a method for constructing a shoe is shown, comprising the steps of: providing 201 an outsole comprising a lip that extends around a periphery of the outsole; creating 202 a first hole and a second hole in a first portion of the periphery; creating 203 a third hole and a fourth hole in a second portion of the periphery; providing 204 an upper with a left hole, a left center hole, a right center hole, and a right hole, the upper having an inside and an outside; securing 205 the upper to the outsole by a stitch, comprising the steps of: extending 205*a* a first thread from the first hole, through the right hole, through the right center hole, through the second hole, and through the third hole; and extending 205*b* a second thread from the right hole, through the first hole, through the second hole, through the left center hole, and through the third hole. The securing step further includes securing 206*a* the inside against the outsole; and securing 206*b* the outside against the outsole.

In FIG. 9, a method for constructing a shoe is shown that is similar to that of FIG. 8, except that the step of providing 301 an outsole comprising a lip that extends around a periphery of the outsole also includes forming a side surface, a top surface, and a lip surface around the periphery of the outsole. The step of creating 302 a first hole and a second hole in a first portion of the periphery also includes extending the first hole and the second hole from the top surface to the side surface. The step of creating 303 a third hole and a fourth hole in a second portion of the periphery also includes extending the third hole and the fourth hole from the lip surface to the side surface. Finally, securing 306*a* the outside against the outsole includes securing against the lip surface and securing 306*b* the inside against the outsole includes securing against the top surface.

Thus, the present invention provides a simple, cost-effective shoe construction and method for constructing shoes that allows for variability in the appearance from one portion of the shoe to another. Although the invention has been described with reference to embodiments with certain constructions, structures, ingredients and formulations and the like, these are not intended to exhaust all possible arrangements or features, and indeed many other modifications and variations will be ascertainable to those of skill in the art.

What is claimed is:

1. A shoe, comprising:

an outsole having a lip extending around a periphery of the outsole;

an upper having an inside and an outside for securing to the outsole adjacent to the lip;

wherein said outside is facing and is secured to said outsole by a stitch in a first portion of the periphery; and wherein said inside is facing and is secured to said outsole by said stitch in a second portion of the periphery; and wherein said outsole includes a first hole, a second hole, a third hole, and a fourth hole;

said upper includes a right hole and a right center hole aligned with said first and second holes and a left center hole and a left hole aligned with said third and fourth holes;

a first thread extending from said first hole, through said right hole, through said right center hole, through said second hole, and through said third hole; and a second thread extending from said right hole, through said first hole, through said second hole, through said left center hole, and through said third hole.

2. The shoe according to claim 1, further comprising a socklining beneath said outside and said inside but above said outsole.

3. The shoe according to claim 1, wherein said outsole includes a side surface, a top surface, and a lip surface;

wherein said outside is facing and is secured to said lip surface; and wherein said inside is facing and is secured to said top surface.

4. The shoe according to claim 3, wherein said first hole and said second hole extend from said top surface to said side surface; and wherein said third hole and said fourth hole extend from said lip surface to said side surface.

5. The shoe according to claim 3, wherein said inside is facing and is secured to said top surface in a rear part of the shoe and said outside is facing and is secured to said lip surface in a front part of the shoe.

6. The shoe according to claim 3, wherein the stitch comprises an upper row of stitching on the upper and a lower row of stitching on the side surface of the outsole;

wherein said lower row of stitching is visible on the side surface of the outsole in said first and second portions of the periphery; and wherein said upper row of stitching is visible on the outside of said upper in said second portion of the periphery and said upper row of stitching is not visible in said first portion of the periphery.

7. A shoe, comprising:

an outsole including a lip extending around a periphery of the outsole;

said outsole including a side surface, a top surface, and a lip surface;

said outsole including a first hole and a second hole extending from said top surface to said side surface and a third hole and a fourth hole extending from said lip surface to said side surface;

an upper including a right hole, a right center hole, a left center hole, and a left hole;

a first thread extending from said first hole, through said right hole, through said right center hole, through said second hole, and through said third hole; and a second thread extending from said right hole, through said first hole, through said second hole, through said left center hole, and through said third hole.

8. The shoe according to claim 7, wherein said upper has an inside and an outside;

wherein said inside is facing and secured to said top surface by the first thread; and wherein said outside is facing and secured to said lip surface by the second thread.

9. The shoe according to claim 7, further including a channel in said side surface extending around the periphery of the outsole.

10. A method for constructing a shoe, comprising the steps of:

providing an outsole comprising a lip that extends around a periphery of the out-sole;

creating a first hole and a second hole in a first portion of the periphery;

creating a third hole and a fourth hole in a second portion of the periphery;

providing an upper with a left hole, a left center hole, a right center hole, and a right hole, said upper having an inside and an outside;

securing the upper to the outsole by a stitch, comprising the steps of:

extending a first thread from said first hole, through said right hole, through said right center hole, through said second hole, and through said third hole; and extending a second thread from said right hole, through said first hole, through said second hole, through said left center hole, and through said third hole.

11. The method of claim 10, wherein said securing step further comprises: securing said inside against the outsole; and securing said outside against the outsole.

12. The method of claim 10, wherein the step of providing an outsole further comprises forming a side surface, a top surface, and a lip surface around the periphery of the outsole.

13. The method of claim 12, wherein the step of creating a first hole and a second hole further comprises extending the first hole and the second hole from said top surface to said side surface; and wherein the step of creating a third hole and a fourth hole further comprises extending the third hole and the fourth hole from said lip surface to said side surface.

14. The method of claim 13, wherein said upper has an inside and an out-side, and wherein said securing step further comprises:

securing said inside against the top surface of the outsole; and securing said outside against the lip surface of the outsole.

* * * * *